United States Patent [19]

Hesse et al.

[11] 4,239,320

[45] Dec. 16, 1980

[54] ELECTRICAL CONNECTOR

[75] Inventors: David L. Hesse, Chicago; Ronald F. Krolak, North Riverside; Jiulio E. Perna, Naperville, all of Ill.

[73] Assignee: Bunker Ramo Corporation, Oak Brook, Ill.

[21] Appl. No.: 317

[22] Filed: Jan. 2, 1979

[51] Int. Cl.[3] ..... H01R 27/02

[52] U.S. Cl. ..... 339/154 A; 179/1 PC; 339/176 M

[58] Field of Search ..... 339/91 R, 97 R, 136, 339/18 R, 18 B, 154 R, 154 A, 103 M, 176 M; 179/1 PC

[56] References Cited

U.S. PATENT DOCUMENTS

| | | | |
|---|---|---|---|
| 2,714,195 | 7/1955 | Beatty | 339/45 |
| 2,930,019 | 3/1960 | Hubbell | 339/31 |
| 3,054,078 | 9/1962 | Baschkin | 339/18 |
| 3,090,027 | 5/1963 | Phillips et al. | 339/31 |
| 3,181,104 | 4/1965 | Oxley | 339/59 |
| 3,300,750 | 1/1967 | Harner et al. | 339/18 |
| 3,453,403 | 7/1969 | Hoffman | 200/51 |
| 3,471,822 | 10/1969 | Van Baelen | 339/18 |
| 3,501,599 | 3/1970 | Horecky | 200/16 |
| 3,753,212 | 8/1973 | Yamada et al. | 339/91 R |
| 3,803,530 | 4/1974 | Lapraik | 339/36 |
| 3,885,849 | 5/1975 | Bailey et al. | 339/31 R |
| 3,936,129 | 2/1976 | Guy | 339/103 R |
| 4,032,209 | 6/1977 | Rutkowski | 339/91 R |
| 4,046,449 | 9/1977 | Ranzanigo | 339/91 R X |
| 4,047,787 | 9/1977 | Gumb et al. | 179/1 PC X |
| 4,070,548 | 1/1978 | Kasper | 179/1 PC |

FOREIGN PATENT DOCUMENTS

| | | |
|---|---|---|
| 1590532 | 6/1971 | Fed. Rep. of Germany . |
| 1690230 | 9/1971 | Fed. Rep. of Germany . |
| 2135728 | 2/1972 | Fed. Rep. of Germany . |

*Primary Examiner*—Roy Lake
*Assistant Examiner*—Eugene F. Desmond
*Attorney, Agent, or Firm*—F. M. Arbuckle; J. R. Hoffman

[57] ABSTRACT

A modularized electrical connector is disclosed and has position adjustable contact elements for engaging selective second contact elements of a complementary electrical connector. The electrical connector includes a housing defining an elongated cavity, with a top portion of the housing having an elongated cavity, with a top portion of the housing having an elongated end opening communicating with the cavity. A movable insert member is provided and includes an insert element constructed and arranged for disposition at any preselected one of a predetermined plurality of positions along the length of the housing cavity. Contact elements are supported by the insert member for mating engagement with selected contact elements of a complementary electrical connector according to the position of the insert member within the cavity. Complementary opposed engaging elements are provided on the insert member and the housing defining the predetermined positions, and including spring means to hold the insert member at any one of the preselected positions. The housing includes a bottom portion having an elongated end opening communicating with the cavity for receiving the complementary electrical connector. A second connector member is removably mounted on the housing spaced from the cavity and supports contact means for mating engagement with contact elements of a second complementary electrical connector. The contact means of the second connector member is electrically connected to the contact means of the insert member.

18 Claims, 10 Drawing Figures

FIG. 1
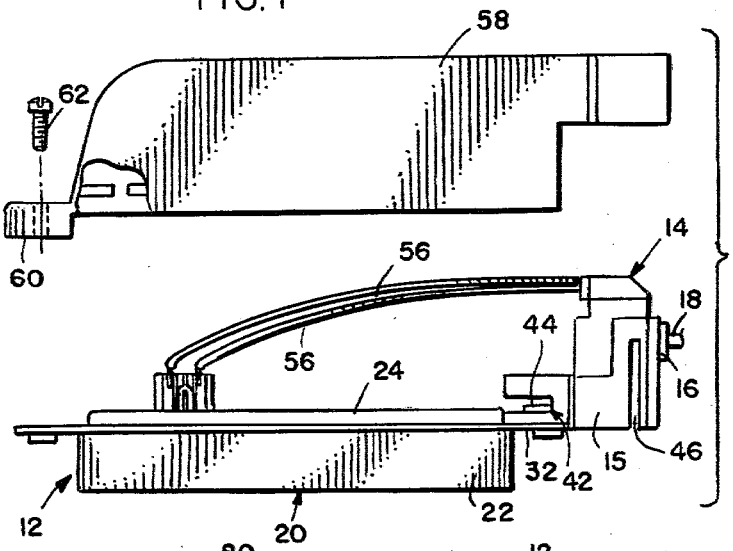
FIG. 2
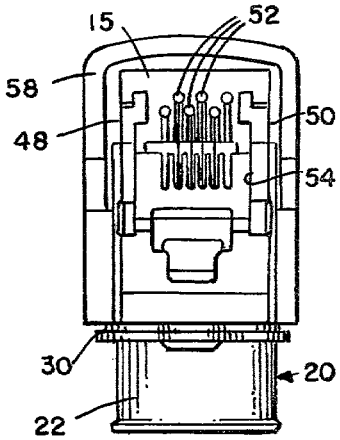
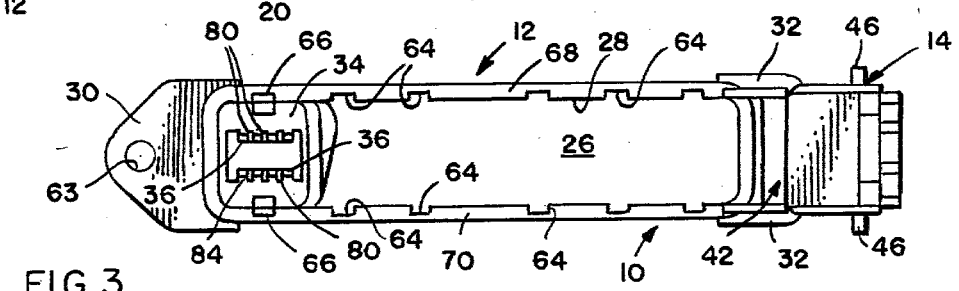
FIG. 3
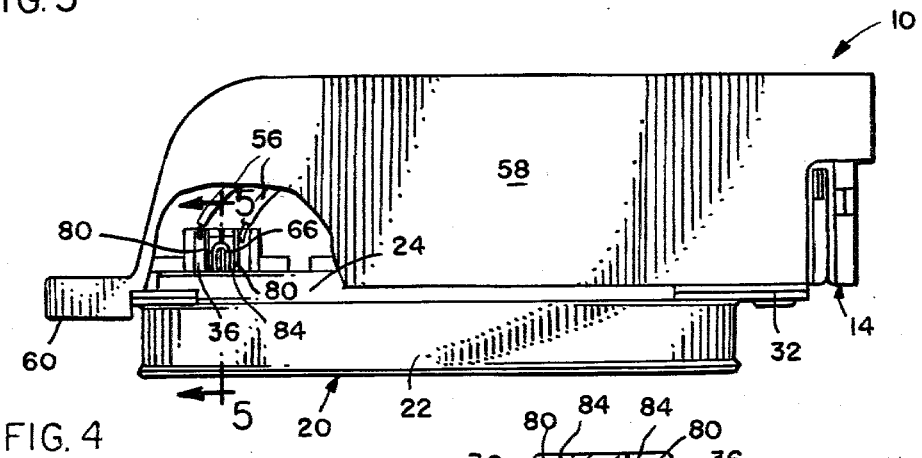
FIG. 4
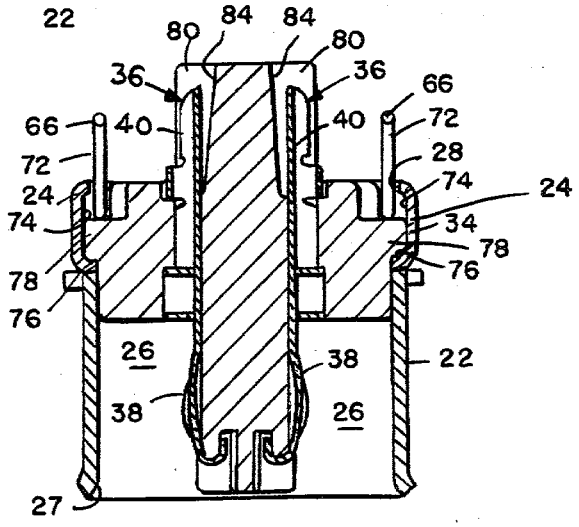
FIG. 5

ELECTRICAL CONNECTOR

RELATED APPLICATION

The application is related to U.S. Patent Application Ser. No. 000,318, filed concurrently herewith in the names of David L. Hesse and Joseph Warywoda, and assigned to the assignee of the present application.

BACKGROUND OF THE INVENTION

The invention relates generally to modular electrical connectors useful, for example, in telephone interconnection systems or the like. More particularly, the invention is directed to new and improved modular connector designs facilitating prompt field service connected and reconnection of electrical circuits in selected circuit patterns with a minimum of effort and time by relatively unskilled personnel.

In telephone interconnection systems and similar environments, individual telephones are required to have one or more specific features according to customer requirements, such as preselected telephone number, multiple-lines, a hold button, etc. The individual telephones must be joined to the system so as to accommodate these requirements. Often, however, these customer requirements change after a period of time necessitating a service call to reconnect the individual telephones into the system according to the new requirements. Heretofore, it has been commonplace to hand-wire and solder leads to the electrical connectors, and thus both installation and later reinstallations have required a tedious unsoldering and resoldering of wires to connector leads according to the modified requirements.

Modularization of telephone interconnection systems has become increasingly popular in order to reduce hardware requirements and the service expense inherent in performing individual conductor terminations. For these reasons, modularized or standardized telephone jack connectors are presently being incorporated into individual telephone units, and standardized telephone plugs have been adopted for terminating both ends of the telephone cord. The interconnection between the conductors and the telephone unit is then effected by the simple mating of a modular plug and jack. In addition, a variety of junction boxes, bridging adapters and other devices have been developed which incorporate modular jack connectors for receiving such plugs, the modular jack connectors being prewired in accordance with the above to one or more standardized connectors disposed in the device. Such standard telephone plugs and jacks are known in the art and are described in Federal Communications Commission Regulations published in the Federal Register, Monday, July 12, 1976.

In lieu of utilizing the above described pre-wired junction boxes and the like, a standardized connector already widely in use, such as the connector sold by Bunker Ramo Corporation under the trademarks "57"and "157" Series, may be individually adapted to the above modular concept and utilized in accordance with the previously described telephone interconnection technique. One form of such an adaptation is described in U.S. Pat. No. 4,070,548, issued Jan. 24, 1978, to Alan Henry Kasper and assigned to the assignee of the present invention. As disclosed in the aforementioned patent, plural conductors electrically interconnect the electrical contacts of the modular connector with one preselected set of contacts in the standardized connector which supports the modular connector, thereby electrically connecting the telephone unit with the desired signal outputs of the telephone switching equipment system. These conductors are generally soldered or otherwise permanently attached to both the modular connector and to the preselected set of contacts in the standardized connector.

It has been found desirable in some instances to eliminate the soldering or other permanent attachment of the conductors to the preselected set of contacts of the standardized connector as well as to provide a full complement of electrical contacts therein which are selectively and releasably engageable with the conductors. Such a capability would reduce the requirement of maintaining a large inventory of pre-wired connectors having different wiring arrangements. It would also eliminate the alternative procedure of detaching the permanently terminated conductors and resoldering them to a different set of contacts on the standardized connector in order to provide electrical interconnection between the single telephone unit and different signal outputs of the telephone signalling and switching system coupled to the standardized connector.

SUMMARY OF THE INVENTION

It is therefore, a primary objective of the present invention to provide a new and improved electrical connector of modular design.

A further object of the present invention is to provide an improved field serviceable electrical connector facilitating electrical connection of a standardized adapter connector member mounted thereon with any selected set of a plurality of sets of electrical contact sets supported by the connector.

In the examplary embodiment of the invention, an electrical connector is provided with position adjustable contact elements for engaging selective second contact elements of a complementary electrical connector. The connector includes a housing which has an elongated cavity. The housing is comprised of a top portion having an elongated end opening communicating with the cavity, and a bottom portion having an elongated end opening communicating with the cavity. A movable insert member is constructed and arranged for disposition through the top opening of the housing to any preselected one of a predetermined plurality of positions along the length of the cavity. Contacts are supported by the insert member for mating engagement with selected contact elements of a complementary electrical connector positionable into the end opening in the bottom portion of the housing, according to the position of the insert member within the cavity. Mounting means is provided for releasably securing the insert member at any one of said preselected positions.

In one embodiment of the invention, the mounting means includes a plurality of sets of recesses formed on opposite sides of the cavity, and spring elements are disposed on opposite sides of the insert member for positioning into and out of the recesses. The spring elements are biased outwardly into the recesses and the insert member can be removed from the cavity by pinching the spring elements inwardly toward each other.

In another embodiment of the invention, the insert member has recesses on opposite sides thereof, and the housing has spring elements defining the preselected positions for the insert member, the spring elements being biased inwardly toward the insert member for positioning in the recesses thereof.

An adapter connector member is releasably mounted on the housing at a position spaced from the housing cavity, and contact means are supported by the adapter connector member for mating engagement with contact elements of a second complementary electrical connector. The contact means of the adapter connector member is electrically connected to the contacts on the insert member.

BRIEF DESCRIPTION OF THE DRAWINGS

The novel features which are believed to be characteristic of the present invention are set forth in the appended claims. The invention itself, however, together with further objects and attended advantages thereof, will become apparant and best understood by reference to the following detailed description taken in connection with the accompanying drawings, setting forth by way of illustration and example certain embodiments of the invention in the several figures of which like reference numerals identify like elements, and in which:

FIG. 1 is a partially exploded side elevational view of one embodiment of the electrical connector assembly of the present invention, with the adapter connector secured to the right hand end thereof;

FIG. 2 is a rear elevational view of the fully assembled connector assembly of FIG. 1;

FIG. 3 is a top plan view of the electrical connector assembly of FIG. 1, particularly illustrating the selected insert positions within the housing, but with the conductors between the insert member and adapter connector member omitted to facilitate the illustration;

FIG. 4 is a side elevational view, with a portion broken away, of the connector assembly of FIG. 1 in its fully assembled condition;

FIG. 5 is a vertical sectional view taken generally along line 5—5 of FIG. 4, through the insert member and illustrating the mounting means for the first embodiment of the present invention;

DETAILED DESCRIPTION OF THE PREFERRED EMBODIMENTS

Figure 6:
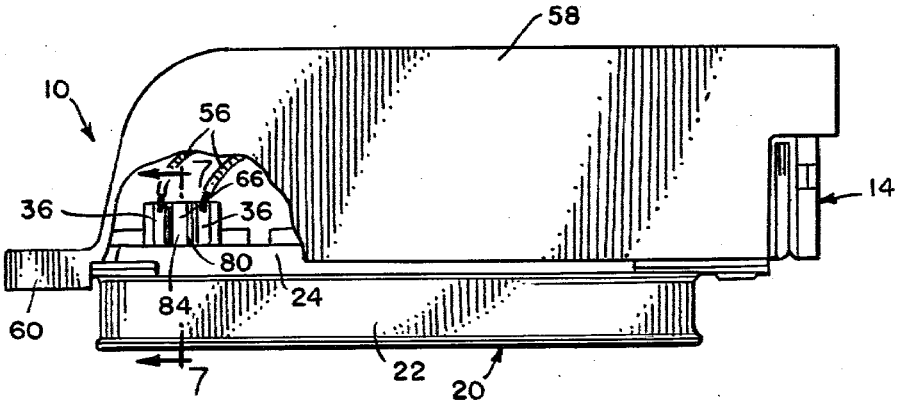
FIG. 6 is a side elevational view, similar to that of FIG. 4, illustrating a second embodiment of the mounting means between the insert member and housing of the connector assembly of the present invention.

Referring to the drawings in greater detail, and first to FIGS. 1 and 2, the electrical connector assembly of the present invention is generally designated 10 and includes an electrical connector, generally designated 12, which has position adjustable contact elements for engagement with a first complementary electrical connector (not shown in the drawings). The electrical connector 12 includes an adapter electrical connector member, generally designated 14, which includes a dielectric body 15 adapted to receive a second complementary electrical connector 16 which terminates a multi-conductor cable 18. In the illustrated form the cable 18 may lead to a single telephone station.

The connector 12 is elongated and preferrably is a ribbon-type connector of the Amphenol 57 Series or 157 Series connectors manufactured and distributed by Amphenol North America Division of Bunker Ramo Corporation. It is envisioned, however, that the present invention may be utilized with any type of ribbon or elongate connector.

The ribbon connector 12 includes an elongated housing shell, generally designated 20, which has a bottom portion 22 interconnected with a top portion 24. The housing shell 20 is preferably substantially rectangular in shape, and the bottom and top portions 22 and 24, respectively, are adapted to define an interior open-ended elongated cavity 26 (FIG. 3). The bottom portion 22 includes an elongated bottom end opening 27 (FIG. 5) for receiving the first complementary connector (not illustrated) within the cavity 26. The top portion 24 similarly includes an elongated end opening 28 (FIG. 3) which communicates with the cavity 26. Mounting flanges 30 and 32 are provided on the forward and rearward ends, respectively, of the connector 12.

Insert means in the form of a dielectric insert body or element 34 is constructed and arranged for disposition at any preselected one of a predetermined plurality of positions within the cavity 26. The insert means or member 34 may be constructed from any electrically insulating material which can be preformed for disposition in the connector 12 and preferably retained by the housing top portion 24. The insert member 34 is sized and shaped to project outwardly through the top end opening 28 and inwardly into the cavity 26 for mating engagement with selected contact elements of the first complementary connector received through the bottom end opening 27 of the housing bottom portion 22. The length of the insert member 34, that is the dimension thereof from left to right in FIGS. 1, 3 and 4, is substantially less than the length of the top opening 28 and cavity 26. The insert member includes a plurality of (e.g. eight) contact elements 36 (FIG. 5), each of which includes an active contact portion 38 projecting into the cavity 26 and a terminal contact portion 40 projecting outwardly from the top end opening 28. The insert member 34 is adapted to be movable so that it may be located at any one of a plurality of discrete selected positions along the length of the end opening 28, as described in greater detail hereinafter. In this manner, the position of the insert member 34 may be adjusted along the length of the top portion 24 of the housing shell 20 so as to selectively vary the interengagement of the contact elements 36 with the contacts elements of the first complementary connector (not illustrated) inserted into the cavity 26.

The adapter connector member 14 preferably is mounted to the rear of the connector 12. For this purpose, a mounting bracket 42 is secured to the flange 32 by a rivet 44 (FIG. 1). The bracket 42 includes a pair of side projections 46 which are received in a pair of grooves disposed in the respective side walls 48, 50 (FIG. 2) of the dielectric body 15. The dielectric body has a plurality of contact elements 52 (FIG. 2) supported therein, and a recess 54 is provided for receiving the second complementary connector 16 (FIG. 1). In this manner, the contact elements of the complementary connector 16 may be engaged with the contact elements 52 by insertion of the connector 16 into the recess 54.

Each contact element 52 is electrically ingaged with a contact element 36 of the insert member 34 by an electrical conductor 56 (FIG. 1), there being at least as many contact elements 36 on the insert member 34 as there are contact elements 52 on the adapter connector member 15. Further details of the mounting bracket 42, the dielectric body 15 and the second complementary connector 16 may be seen in U.S. Pat. No. 4,070,548 issued Jan. 24, 1978 to Allen Henry Kasper and assigned to the assignee of the present invention. Said patent and the contents thereof are incorporated herein by reference. The mounting arrangement of the adapter connector 14 to the connector 12 and a telephone station secured to the cable 18 can be seen in said referenced and incorporated patent.

The connector assembly 10 also includes a hood 58 for covering the connectors 12 and 14, the insert member 34 and the conductors 56. The hood 48 is substantially identical to the hood disclosed in the aforementioned U.S. Pat. 4,070,548 and preferably is constructed of a resilient material, such as a plastic material similar to Valox 310. The hood 58 includes a forward flange 60 which has a slot therein for receiving the forward flange 30 of the connector 12. Means such as a screw or bolt 62 may also be provided for firmly securing the flange 30 within the flange 60, by the bolt 62 extending through a hole 63 in flange 30. Further details of the hood 58 may be found in the aforementioned patent.

Referring to FIGS. 3–5 wherein the first embodiment of the connector assembly 10 of the present invention is illustrated, the insert member 34 is longitudinally movable within the elongated end opening 28 in the top portion 24 of the housing between discrete selected positions therealong. Mounting means is provided for maintaining the insert 34 in cooperative engagement with the shell top portion 24 of the housing at each of the selected positions. The mounting means includes means for disengaging the insert member 34 from the shell top portion 24 to permit movement of the insert member 34 to any one preselected position along the length of cavity 26. The mounting means preferrably includes a plurality of engaging elements disposed opposite each other on the insert member 34 and the shell top portion 24. More particularly, in the embodiment illustrated in FIGS. 3–5, a plurality of paired recesses 64 are disposed opposite each other at spaced positions along the longitudinal side edges 68, 70 (FIG. 3) of the shell top portion 24 along the inside of the top opening 28. Each opposed pair of recesses 64 defines one of the discrete predetermined plurality of positions at which the insert member 34 may be located within the cavity 26. A pair of opposed resilient spring members 66 are provided on the insert member 34, one spring member 66 on each opposite side of the insert member. Each spring member 66 is formed by a U-shaped wire spring having legs 72 (FIG. 5) secured at their ends to the insert member 34. The insert member 34 is releasably mounted within the cavity 26 by the spring members 66 being resiliently biased outwardly into the recesses 64. The insert member 34 thus can be moved longitudinally along the cavity 26 to any preselected position defined by the opposed pairs of recesses 64 by pinching the spring members inwardly toward one another and sliding the insert member 34 along the cavity longitudinally of the connector member 12.

Referring more particularly to FIG. 5, the interior transverse dimension of the shell top portion 24 is slightly greater than the interior transverse dimension of the shell bottom portion 22 so as to define a pair of parallel longitudinal channels 74 along the inner sides of the shell top portion 24, a bottom longitudinal edge 76 of each channel 74 forming an elongated ledge. The insert member 34 includes a pair of bosses 78 on opposite sides thereof which ride along the longitudinal ledges 76 for free movement therealong when the springs 76 are disengaged from the recesses 64. In this manner, the insert member 34 is firmly maintained within the connector 12 and is freely movable along the length of the cavity 26, the free sliding movement on the insert member 34 being interrupted by the engagement of the springs 66 with a pair of recesses 64 at any one of the discrete selected positions defined thereby. In the preferred embodiment of the invention, the insert member 34 includes a plurality of spaced ribs 80 on the top opposite sides thereof to define four pairs of channels 84 (FIG. 5) therebetween which receive, respectively, four pairs of contact elements 36. The complementary ribbon connector (not illustrated), which matingly engages the connector 12 within the cavity 26 through the bottom opening 27, preferably includes a plurality (generally 25) pairs of contact elements aligned in two opposing rows. As can be seen from the above the pairs of recesses 64 preferrably are arranged in six discrete positions along the length of cavity 26. Therefore, the present embodiment permits the engagement of the contact elements 36 of the insert member 34 with six different sets of contact elements of the complementary ribbon connector, thereby permitting the connector 12 to be engaged with any one of six circuits leading from the ribbon connector to its interconnected telephone signal and switching equipment.

The connection of the connector 12 from one circuit of the complementary ribbon connector to the other is changed by removing the hood 58 from the connector assembly 10. The insert member 34 and associated components thereof then are exposed and the pair of springs 66 may be displaced by pinching the springs inwardly towards each other for disengagment from the particular pair of opposing recesses 64. The insert member 34 then can be slidingly moved along the longitudinal ledges 76 along the cavity 26 to another desired location, whereupon the springs 72 can be released and engaged within a newly aligned pair of recesses 64. The insert member 34 therefore is repositioned relative to the housing or shell 20 so that when the complementary ribbon connector is remated with the connector 12, the contact elements 36 engage a new set of corresponding contact elements on the complementary ribbon connector and thereby complete a new circuit through the connector assembly 10.

Figure 7:
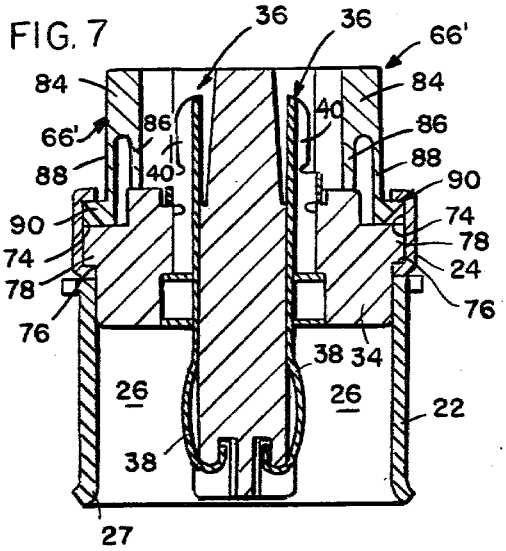
FIG. 7 is a vertical sectional view taken generally along line 7—7 of FIG. 6.

Referring now to FIGS. 6 and 7, a second embodiment of the present invention is illustrated wherein a different mounting means arrangement is utilized. Like numerals will be applied for corresponding components described in relation to the embodiment illustrated in FIGS. 1–5. In this particular embodiment, the connector assembly 10 is substantially identical to the connector assembly shown in FIGS. 1–5 except for the mounting means arrangement. The mounting means illustrated in FIGS. 6 and 7 includes the plurality of pairs of recesses 64 (FIG. 3) disposed along the longitudinal side edges 68, 70 of the shell top portion 24, and a pair of resilient springs members 66' are disposed on opposite sides of the insert member 34. Each resilient spring member 66' is comprised of a spring clip 84 having a pair of bifurcated legs 86 and 88. The base of each leg 86 is secured to the insert member 34 for movement therewith, while the leg 88 comprises a latching leg which is generally cantilevered and disposed outwardly relative to the leg 86 as seen in FIG. 7. A latching element in the form of an outwardly directed lip 90 projects into the channel 74 of the shell top portion 24 for biased engagement against the inner surface thereof. In this manner, the insert member 34 is freely movable between the positions defined by the pairs of recesses 64, and when the insert member 34 is positioned whereby the pair of latching legs 88 are disposed opposite a pair of recesses 64, the spring biased legs 88 move outwardly into the recesses. Such engagement maintains the insert member 34 in a selected position within the cavity 26. In order to move the insert member 34 to another selected position, the legs 88 are displaced inwardly toward each other, thereby permitting the insert member 34 to be freely moved along the length of the cavity 26 of the connector 12.

Figure 10:
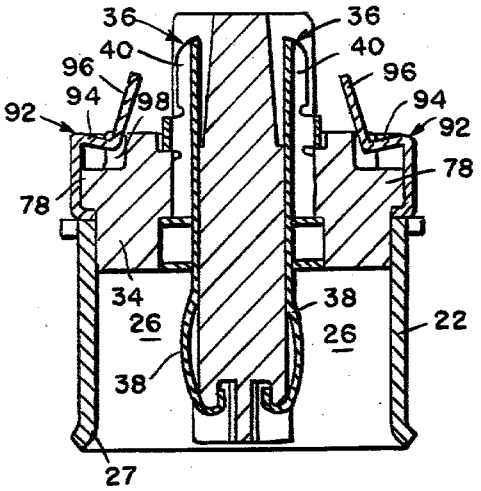
FIG. 10 is a vertical sectional view taken generally along line 10—10 of FIG. 9.
Figure 8:
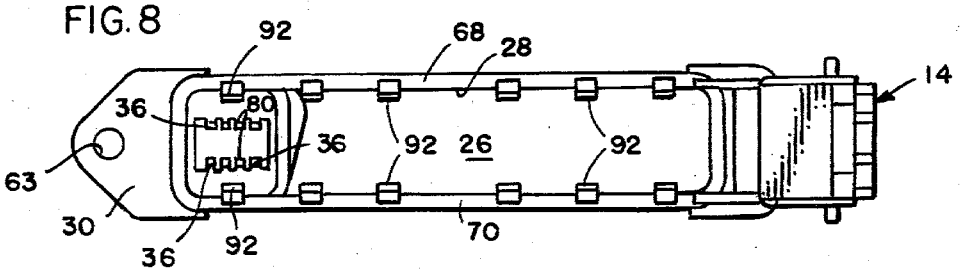
FIG. 8 is a top plan similar to that of FIG. 3 but illustrating a third embodiment of the mounting means between the insert member and housing.
Figure 9:
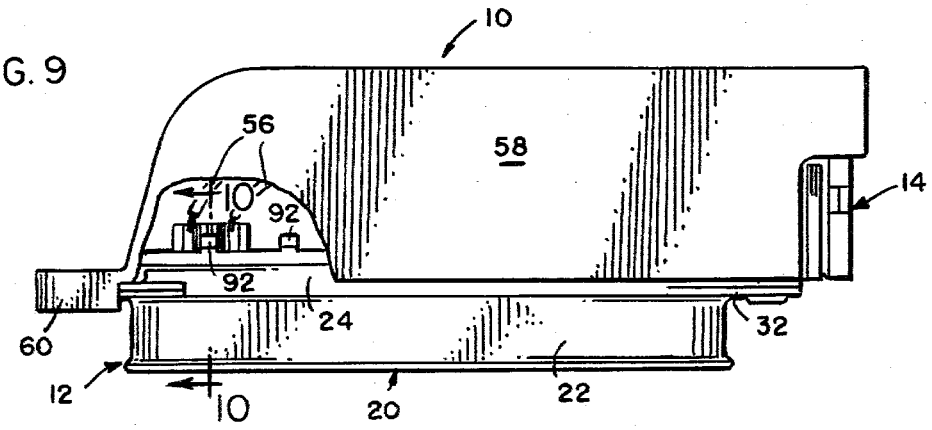
FIG. 9 is a side elevational view, partially broken away, of the embodiment of the invention shown in FIG. 8.

Referring to FIGS. 8–10, a third embodiment of the invention is disclosed wherein a third mounting means arrangement is utilized. Here again, like numerals are applied to similar components corresponding to those previously described in relation to FIGS. 1–5. In the embodiment illustrated in FIGS. 8–10, the top shell portion 24 includes a plurality of pairs of resilient fingers, generally designated 92, disposed opposite each other at spaced positions along the longitudinal side edges 68, 70 of the top opening 28. Each spring finger 92 includes an angularly inwardly directed portion 94 and an upwardly directed portion 96 extending from the inner end of portion 94. Therefore, each spring finger 92 projects inwardly toward the longitudinal center line of the shell top portion 24 and extends over the top end opening 28. The insert member 34 includes a pair of recesses 98 (FIG. 10) disposed on opposite sides thereof for receiving and engaging a pair of the spring fingers 92.

As described in the previous embodiments, the insert member 34 of FIGS. 8–10 is freely movable along the cavity 26 until the pair of recesses 98 of the insert member are aligned with a pair of the spring fingers 92. With this arrangement, the spring fingers 92, which are biased inwardly toward the insert member 34, the engage the recesses 98 to maintain the insert member 34 in a preselected position. When it is desired to move the insert member 34 to another selected position along the shell top portion 24 longitudinally along the cavity 26, the upper end portions 96 of the respective opposed pair of spring fingers 92 are displaced outwardly away from each other to disengage the spring fingers 92 from the recesses 98. In this manner, the insert 34 then becomes freely movable to another position for engagement with a different pair of spring fingers 92.

It should be noted that while the mounting means of the above embodiments disclose specific engaging element arrangements, the present invention is not to be limited thereby. It is contemplated that any arrangement of engaging elements disposed along the longitudinal side edges of the cavity 26 and along the opposing sides of the insert member 34 may be utilized whereby the insert member may be maintained at selected positions along the length of the connector 12 and be freely movable between such selected positions so as to engage selectively varied sets of contact elements of a complementary ribbon connector mated with the connector 12.

From the above, it can be seen that the present invention provides an electrical connector wherein the position of the contact elements within the connector are adjustable so as to engage selectively varied contact elements of a mating ribbon connector. This enables selective change of the circuits passing through the connector 12 from the complementary ribbon connector without resoldering or otherwise reconnecting the conductors leading to the connector contact elements. Furthermore, the present invention permits the engagement of a multi-conductor cable leading from a single telephone station with any one of a plurality of available circuits provided at a connector complementary to the connector assembly of the present invention without readjusting the connections of the conductors within the connector assembly. In this manner, switching of the circuits leading to a single telephone station may be performed in the field and be effected quickly, easily, and without the use of tools. Furthermore, in any instance where conductor terminations are changed, the possibility of damaging the conductors and the contact elements is present, and the present invention avoids the possibility of such occurences. Thus, the present invention reduces the costs and complexity of rearranging circuits from telephone signal and switching equipment to individual telephone stations.

It will be understood that the invention may be embodied in other specific forms without departing from the spirit or central characteristics therof. The present examples and embodiments, therefore, are to be considered in all respects as illustrative and not restrictive, and the invention is not to be limited to the details given herein but may be modified within the scope of the appended claims.

I claim:

1. An electrical connector for mating with a complementary connector having a plurality of fixed contact elements, comprising:

housing means defining a cavity;

insert means including an insert element constructed and arranged for disposition at any preselected one of a predetermined plurality of positions within said cavity;

mounting means for releasably securing said insert means at any one of said preslected positions;

contact means, lesser in number than the contact elements of said complementary connector, supported by said insert means for mating engagement with selected contact elements of said complementary electrical connector according to the position of said insert means within said cavity to change the circuit through the connectors; and an adapter connector member on said housing means at a position spaced from said cavity, contact means supported by said adapter connector member for mating engagement with contact elements of a second complementary electrical connector, said contact means of said adapter connector member being electrically connected to said contact means on said insert means.

2. The electrical connector of claim 1, wherein said mounting means includes complementary opposed engaging elements on said insert means and said housing means, including resilient means to hold said insert means at said one preselected position.

3. The electrical connector of claim 2, wherein said engaging elements include means defining a recess formed on the inside of said cavity at said one preselected position and a spring element disposed on said insert means movable into and out of said recess, said spring element being biased outwardly into the recess.

4. The electrical connector of claim 2, wherein said engaging elements include means defining a pair of opposed recesses formed on opposite sides of said cavity at said one preselected position and a pair of spring elements disposed on opposite sides of said insert means movable into and out of said recesses, said spring elements being biased outwardly into the recesses whereby said insert means can be removed from said cavity by pinching said spring elements toward each other.

5. The electrical connector of claim 2, wherein said engaging elements include means defining a recess formed on the outside of said insert means and a spring element disposed on said housing adjacent said one preselected position, said spring element being biased inwardly into said recess.

6. The electrical connector of claim 2, wherein said engaging elements include means defining a pair of oppositely directed recesses formed on opposite sides of said insert means and a pair of spring elements disposed on said housing means on opposite sides of said cavity adjacent said one preselected position, said spring elements being biased inwardly into said recesses.

7. The electrical connector of claim 2, wherein said cavity is elongated and said mounting means includes a plurality of sets of said engaging elements along said cavity defining said predetermined positions.

8. The electrical connector of claim 1, including means for releasably mounting said adapter connector member on said housing means.

9. The electrical connector of claim 1, wherein said housing means includes a top portion and an interconnected bottom portion, said top portion having an end opening adapted to receive said insert means, and said bottom portion having an end opening adapted to receive said complementary electrical connector.

10. The electrical connector of claim 1, wherein said mounting means is disposed on said insert means and said top portion of said housing means.

11. An electrical connector having position adjustable contact elements for engaging selective ones of a plurality of fixed second contact elements of a complementary electrical connector, comprising:

housing means defining an elongated cavity and including a top portion having an elongated end opening communicating with said cavity;

a movable insert means including an insert element constructed and arranged for disposition through said opening at any preselected one of a predetermined plurality of positions along the length of said cavity;

mounting means for releasably securing said insert means at any one of said preselected positions;

contact means, lesser in number than the contact elements of said complementary connector, supported by said insert means for mating engagement with selected contact elements of said complementary electrical connector according to the position of said insert means within said cavity to change the circuit through the connectors; and an adapter connector member on said housing means at a position spaced from said cavity, contact means supported by said adapter connector member for mating engagement with contact elements of a second complementary electrical connector, said contact means of said adapter connector member being electrically connected to said contact means on said insert means.

12. The electrical connector of claim 10, wherein said housing means includes a bottom portion having an elongated end opening communicating with said cavity for receiving said complementary electrical connector.

13. The electrical connector of claim 10, wherein said mounting means includes complementary opposed engaging elements on said insert means and said housing means, including resilient means to hold said insert means at said one preselected position.

14. The electrical connector of claim 13, wherein said engaging elements include means defining a recess formed on the inside of said cavity at said one preselected position and a spring element disposed on said insert means movable into and out of said recess, said spring element being biased outwardly into the recess.

15. The electrical connector of claim 13, wherein said engaging elements include means defining a pair of opposed recesses formed on opposite sides of said cavity at said one preselected position and a pair of spring elements disposed on opposite sides of said insert means movable into and out of said recesses, said spring elements being biased outwardly into the recesses whereby said insert means can be removed from said cavity by pinching said spring elements toward each other.

16. The electrical connector of claim 13, wherein said engaging elements include means defining a recess formed on the outside of said insert means and a spring element disposed on said housing adjacent said one preselected position, said spring element being biased inwardly into said recess.

17. The electrical connector of claim 13, wherein said engaging elements include means defining a pair of oppositely directed recesses formed on opposite sides of said insert means and a pair of spring elements disposed on said housing means on opposite sides of said cavity adjacent said one preselected position, said spring elements being biased inwardly into said recesses.

18. The electrical connector of claim 10, including means for releasably mounting said adapter connector member on said housing means.

* * * * *